US008045914B2

(12) United States Patent
Kato et al.

(10) Patent No.: US 8,045,914 B2
(45) Date of Patent: Oct. 25, 2011

(54) IMAGE FORMING APPARATUS

(75) Inventors: Hiroshi Kato, Odawara (JP); Motoyasu Muramatsu, Meridian, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 573 days.

(21) Appl. No.: 11/684,227

(22) Filed: Mar. 9, 2007

(65) Prior Publication Data

US 2008/0044213 A1 Feb. 21, 2008

(30) Foreign Application Priority Data

Mar. 15, 2006 (JP) ..... 2006-071331

(51) Int. Cl.
*G03G 15/00* (2006.01)

(52) U.S. Cl. ..... 399/405; 399/400; 399/401

(58) Field of Classification Search ..... 399/405, 399/400, 401
See application file for complete search history.

(56) References Cited

U.S. PATENT DOCUMENTS

| | | | | |
|---|---|---|---|---|
| 4,959,693 | A * | 9/1990 | Mitsuya et al. | 399/322 |
| 6,065,747 | A * | 5/2000 | Khovaylo et al. | 271/209 |
| 6,374,063 | B1 * | 4/2002 | Todome | 399/18 |
| 7,020,411 | B2 | 3/2006 | Awaya | 399/92 |
| 2005/0201794 | A1 * | 9/2005 | Suzuki | 399/405 |
| 2006/0022396 | A1 | 2/2006 | Muramatsu | 271/121 |
| 2006/0051123 | A1 | 3/2006 | Awaya | 399/92 |
| 2006/0133865 | A1 * | 6/2006 | Nakamura et al. | 399/320 |
| 2006/0159501 | A1 * | 7/2006 | Matsutomo | 399/410 |
| 2006/0285900 | A1 * | 12/2006 | Kurita | 399/361 |

FOREIGN PATENT DOCUMENTS

| | | | |
|---|---|---|---|
| JP | 03143865 | A * | 6/1991 |
| JP | 09-034321 | | 2/1997 |
| JP | 09-034323 | | 2/1997 |
| JP | 2003-208043 | | 7/2003 |
| JP | 2003-307996 | | 10/2003 |
| JP | 2005-148674 | | 6/2005 |
| JP | 2005148674 | A * | 6/2005 |
| JP | 2005-196079 | | 7/2005 |
| JP | 2006-011148 | | 1/2006 |

* cited by examiner

*Primary Examiner* — Daniel J Colilla
*Assistant Examiner* — Allister Primo
(74) *Attorney, Agent, or Firm* — Fitzpatrick, Cella, Harper & Scinto

(57) ABSTRACT

An image forming apparatus includes: a fixing unit which fixes toner image on a sheet by heat; a first portion in which the sheet on which the toner image is fixed by the fixing unit is fed; a second portion in which the sheet on which the toner image is fixed by the fixing unit is fed; and a fan provided between the first portion and the second portion and for cooling the sheet in the first portion and the sheet in the second portion.

7 Claims, 9 Drawing Sheets

IMAGE FORMING APPARATUS

BACKGROUND OF THE INVENTION

1. Field of the Invention

The present invention relates to an image forming apparatus and is suitably applicable to specifically an image forming apparatus having a fan for cooling a sheet.

2. Description of the Related Art

In recent years, print of a color image forming apparatus has been demanded to be high-speed and consequently, printed sheets are stacked on a discharge stacking unit before heat at the time of ink fixing is cooled. Thus, countermeasures for defects such as sheet adhesion, image rubbing, separation and the like, which occur due to contact between toners particularly at the time of two-side print have been urgently demanded.

When the curl amount of a sheet which is produced by reversing at the time of two-side print is large, it may affect conveyance and transfer of a sheet, print accuracy and the like. More specifically, there are such problems as breaking of a front end, winding of a sheet around a roller, jamming, transfer failure, skewing and thus; therefore, solutions for these problems have been demanded from viewpoints of improvement of print quality.

The sheets stacked on the stacking tray are under high temperatures due to heat at the time of fixing. If the sheet at this high temperature is stacked as it is, toner on an image face is likely to adhere to the sheet. As a consequence, a problem in image defect such as distortion of image face and contamination of sheet rear face may occur. Particularly, when images are formed on two sides, the sheets are stacked successively, so that this problem is likely to occur due to contacts of one toner with another toner.

For the reason, conventionally as a countermeasure thereto, providing a conveying path with a fan so as to lower the sheet temperature has been proposed in Japanese Patent Application Laid-Open No. 2005-148674. In this structure one fan is installed in the duct with the two vents for two sheet trays. Because the distance of the sheets on the trays and the fan is long, there is a possibility that the sheet may not be cooled sufficiently by the fan.

According to Japanese Patent Application Laid-Open No. 2006-011148, a fan is provided on the bottom of the side face of the apparatus below the downstream end of the conveying path. Because the fan cools the sheets in one portion, the fan is not efficiently used. In addition, a sheet to be reversed for forming images on two sides is under a high temperature and when, such a high temperature sheet is conveyed in order to form, an image on the rear face, the temperature within the apparatus compartment is raised or the transfer unit is heated.

Japanese Patent Application Laid-Open No. 2005-196079 has disclosed an image forming apparatus comprising an image reading unit, a fixing apparatus, a reversal paper discharge unit and a motor fan. According to the structure described in the Japanese Patent Application Laid-Open No. 2005-196079, an opening portion of the motor fan is disposed perpendicularly to the conveying direction of the sheet such that it opposes an area containing the image reading unit and the reversal paper discharge unit and a wind passage direction is along the width direction of the sheet. Because the motor fan is disposed on the back side in a direction perpendicular to the conveying direction with respect to the reversal paper discharge unit and a sheet stacking portion, the distance of the motor fan and the cooling object (the reversal paper discharge unit and the sheet stacking portion) is long. Therefore there is a possibility that the sheet may not be cooled sufficiently by the motor fan.

Japanese Patent Application Laid-open No. 2003-307996 has described a structure in which a fan is provided on the side portion of the apparatus in order to discharge air around a discharge stacking means, on which the sheets are to be stacked to the outside. Because there is a conveying path between the fan and the discharge stacking means, a distance between the fan and the sheets stacked on the discharge stacking means is so long that the stacked sheets may not be cooled sufficiently.

SUMMARY OF THE INVENTION

Accordingly, an object of the present invention is to provide an image forming apparatus capable of cooling sheets in two portions effectively with a fan.

To achieve above-mentioned object, an image forming apparatus comprises:

a fixing unit which fixes toner image on a sheet by heat;

a first portion in which the sheet on which the toner image is fixed by the fixing unit is fed;

a second portion in which the sheet on which the toner image is fixed by the fixing unit is fed; and a fan provided between the first portion and the second potion and for cooling the sheet in the first portion and the sheet in the second portion.

According to the present invention, the sheet in two portions can be cooled effectively.

Further features of the present invention will become apparent from the following description of exemplary embodiments with reference to the attached drawings.

BRIEF DESCRIPTION OF THE DRAWINGS

The invention, together with further advantages thereof, may best be understood by reference to the following description taken in conjunction with the accompanying drawings in which.

DESCRIPTION OF THE PREFERRED EMBODIMENTS

Figure 1:
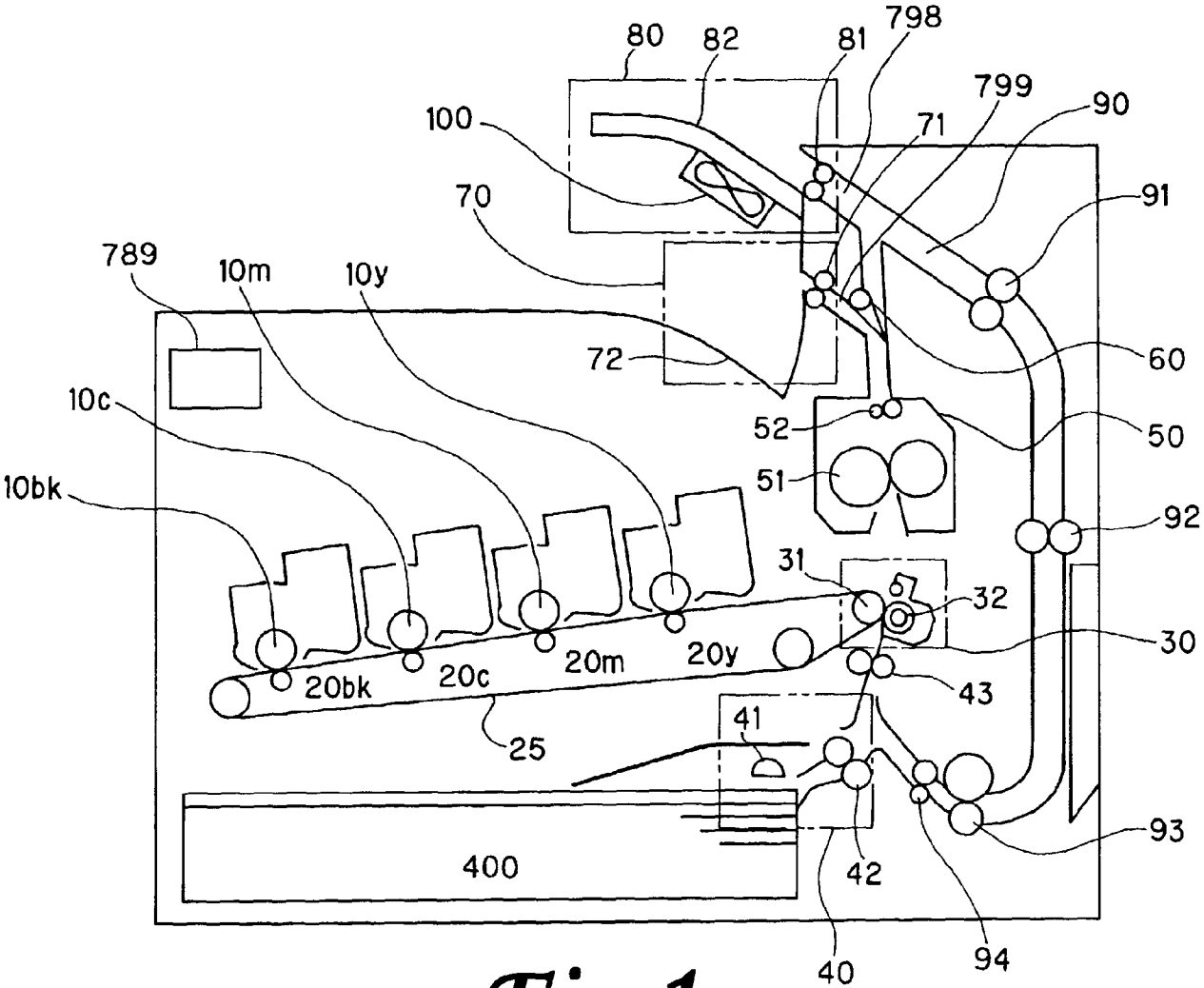
FIG. 1 is a schematic diagram showing the structure of an image forming apparatus according to a first embodiment of the present invention.

Hereinafter, the preferred embodiments of the present invention will be described with reference to the accompanying drawings. In all Figures of following embodiments, like reference numerals are attached to like or corresponding components.

First Embodiment

The first embodiment of the present invention will be described with reference to the accompanying drawings. FIG. 1 shows an image forming apparatus of the first embodiment of the present invention.

As shown in FIG. 1, the first embodiment comprises four electrophotographic photosensitive drums 10*y*, 10*m*, 10*c*, 10*bk* (hereinafter referred to as photosensitive drum 10) corresponding to yellow, magenta, cyan and black. An intermediate transfer belt 25 is stretched against the photosensitive drums 10 as an image bearing member.

A toner image formed on the surface of the photosensitive drum 10 is transferred primarily to this intermediate transfer belt 25. This intermediate transfer belt 25 is stretched and sandwiched between a drive roller 31 and a driven roller 32. A secondary transfer means 30 is disposed at a position opposing the driven roller 32 across this intermediate transfer belt 25.

On the other hand, a transfer sheet 400 picked up by a pickup roller 41 from a sheet cassette is separated and fed by a separating means (not shown) individually. After that, this transfer sheet 400 is sent to a registration roller pair 43 by a conveyance roller pair 42.

This transfer sheet 400 is conveyed between the intermediate transfer belt 25 and the secondary transfer means 30 at a predetermined timing by the registration roller pair 43. Then, the toner image transferred primarily to the intermediate transfer belt 25 is transferred secondarily to the transfer sheet 400 by the action of the secondary transfer means 30.

The transfer sheet 400 to which, the toner image has been transferred is sandwiched and conveyed by a fixing roller 51 in a fixing unit 50 so that the toner image is fixed with heat from the fixing unit 50. After that, the transfer sheet 400 on which the toner image is fixed is conveyed by a fixing discharge roller pair 52 and conveyed to a passage provided on the top of the apparatus main body.

At the time of one-side print, the transfer sheet 400 is conveyed to a discharge passage 799 by changing over a flapper 60 and discharged to a discharge stacking unit 70. The transfer sheet 400 discharged by a discharge roller pair 71 as a discharge member is stacked successively on a stacking tray 72. That is to say, the transfer sheet 400 on which the image is fixed by the fixing unit 50 is fed in the discharge stacking unit 70 as a first portion.

A reversal tray 82 as a conveying guide is provided above the stacking tray 72. The reversal tray 82 guides the bottom, face of the transfer material conveyed by a normally/reversibly rotatable reversing roller pair 81 in a reversed state. The reversal tray 82 forms a reversal conveying path 798 through which the transfer sheet conveyed by the reversing roller pair 81 in a reversed state passes. The transfer sheet conveyed by the reversing roller pair 81 is supported by the top face of the reversal tray 82. A cooling fan 100 controlled by a control unit 789 is provided on the reversal tray 82 as a cooling means. A position of the cooling fan 100 in the width direction (perpendicular direction to paper surface of FIG. 1) is a position opposing the surface of the sheet guided by the reversal tray 82. The position of the cooling fan 100 in the width direction is a position opposing the top face of the sheet stacked on the stacking tray 72.

The conveying path is changed over by the flapper 60 at the time of two-side printing. Then, the transfer sheet 400 on which a single-side printing is performed is conveyed to a reversing unit 80 formed by the reversal tray 82. That is to say, the transfer sheet 400 on which the image is fixed by the fixing unit 50 is fed in the reversing unit 80 as a second portion. The transfer sheet 400 on which two-side printing is performed is conveyed to the discharge stacking unit 70.

That is, the transfer sheet 400 conveyed by the reversing unit 80 constituted of the reversal tray 82 and the reversing roller pair 81 is conveyed up to a position supported by the reversal tray 62 with its rear end sandwiched by the reversing roller pair 81 which is a reversal conveying member. After that, the transfer sheet 400 is conveyed toward a repeated feeding passage 90 because a motor for driving the reversing roller pair 81 is controlled to be rotated reversely. In this way, the reversing roller pair 81 carries out switch-back conveyance so that it rotates normally to convey the transfer sheet onto the reversal tray 82 and then rotates reversely to convey the transfer sheet from the reversal tray 82 to the repeated feeding passage 90.

The repeated feeding passage 90 guides the transfer sheet in which an image is formed on its front face to the image forming unit again. The transfer sheet 400 conveyed to the repeated feeding passage 90 is carried via conveyance roller pairs 91, 92, 93, 94 successively while timed with an image transferred to the intermediate transfer belt 25 and then the image is transferred secondarily to a second face (rear face) by the registration roller pair 43. In the transfer sheet in which the toner image has been transferred to its second face, the toner image is fixed by the fixing unit 50. After the toner image is fixed, the sheet is stacked on the stacking tray 72.

In the first embodiment, accompanied by speeding-up of the print speed, the transfer sheet 400 is conveyed to the discharge stacking unit 70 and the reversing unit 80 with the fixing heat contained. Then, the transfer sheet 400 stacked on the stacking tray 72 and the sheet being reversed by the reversing unit 80 (transfer sheet guided by the reversing guide 82) are cooled by the cooling fan 100.

Figure 2:
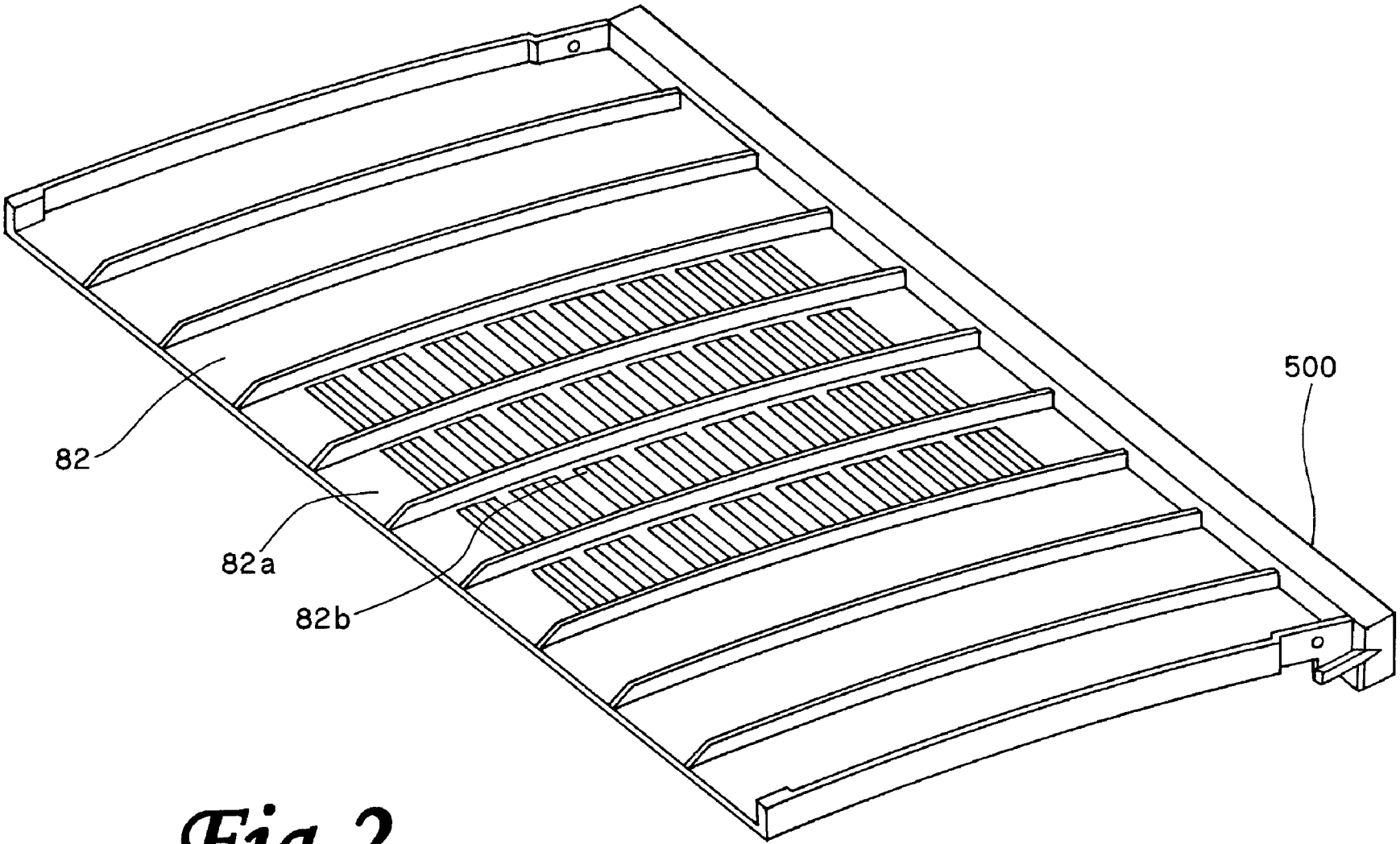
FIG. 2 is a perspective view showing a reversal tray equipped with a cooling fan in the image forming apparatus according to the first embodiment of the present invention.
Figure 3:
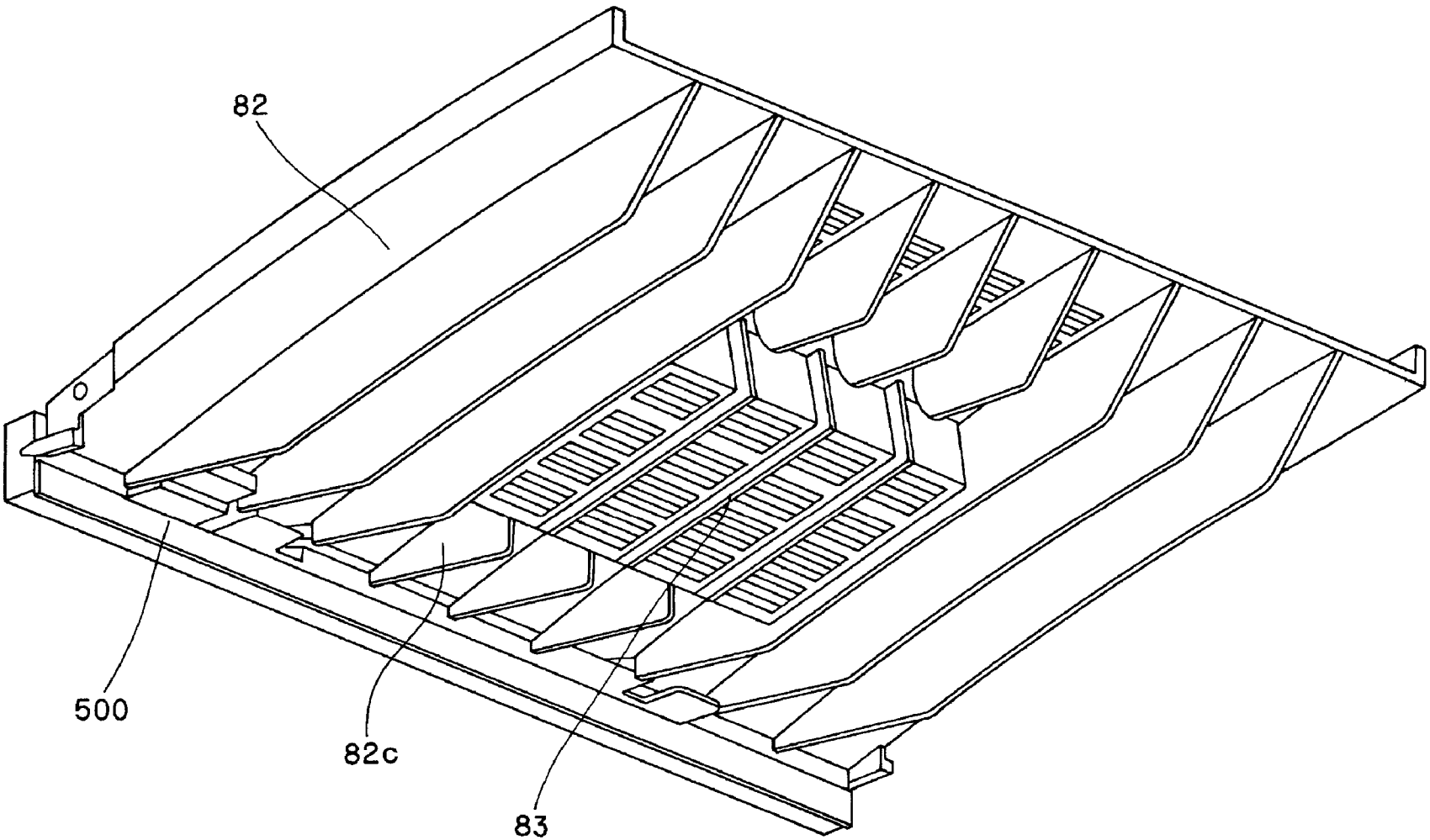
FIG. 3 is a perspective view showing the reversal tray equipped with a cooling fan in the image forming apparatus according to the first embodiment of the present invention.

FIGS. 2, and 3 show schematic views of the reversal tray 82 and its main body connecting portion. FIG. 2 is a perspective view thereof as seen from above and FIG. 3 is a perspective view thereof as seen from below.

As shown in FIGS. 2 and 3, the reversal tray 82 is provided with slits (openings) 82*b* so as to improve air inspiration efficiency. An adhering preventing guide rib 82*a* for preventing the transfer sheet 400 reversed by air inspiration from adhering is provided on the reversal tray 82.

A guide rib 82*c* is provided on the under side of the reversal tray 82 to facilitate conveyance of the sheet. This guide rib 82*c* prevents the transfer sheet 400 discharged onto the stacking tray 12 toy the discharge roller 71 from being caught by the cooling fan 100, thereby preventing conveyance of the sheet from being difficult.

The cooling fan cover 83 which covers the cooling fan 100 has slits for improving air discharge efficiency. That is, the reversal tray 82 has slits which air stream generated by the cooling fan 100 and moving from above the reversal tray 82 constituting the reversing unit to the discharge stacking unit 70 passes through.

As regards installation of the reversal tray 82 on the apparatus main body, a guide is provided along an insertion direction so that the reversal tray 82 can be inserted info a drawer in parallel with respect to the tray lock unit 500 equipped on the main body side.

Figure 4:
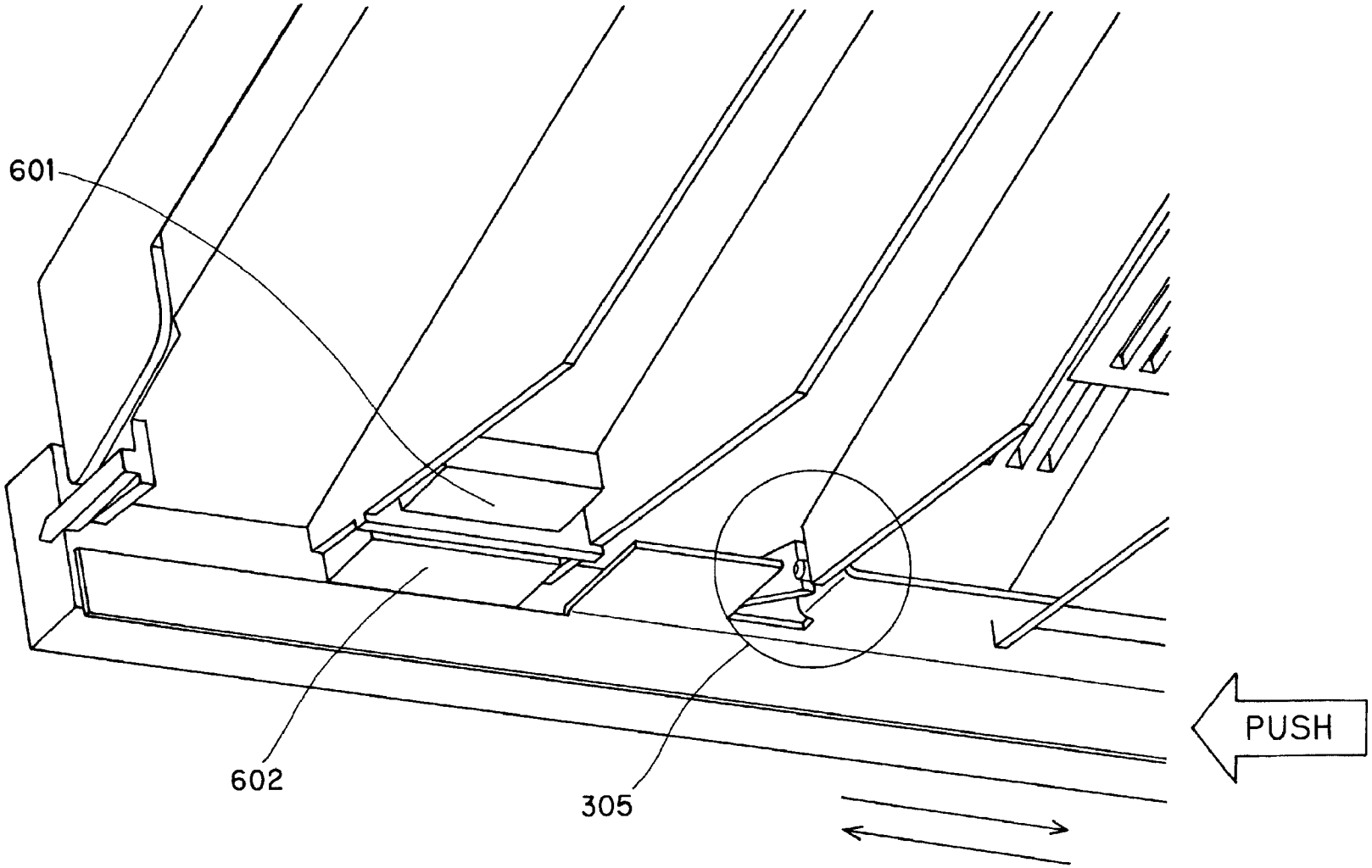
FIG. 4 is a schematic diagram showing a joint portion between the image forming apparatus and the reversal tray in the first embodiment of the present invention.

FIG. 4 shows the tray lock unit 500. By sliding the tray lock unit 500 in the direction of an arrow in FIG. 4, it is caught by a cut-out portion 305 of the reversal tray 82. To activate the cooling fan 100, a drawer connector 601 equipped on the reversal tray 200 and a drawer connector 602 on the main body side are connected to each other so as to supply electricity. The tray lock unit 500 is designed to be at its reference position when it is unloaded because it is urged to the main body by a spring.

(Cooling Process)

Figure 5:
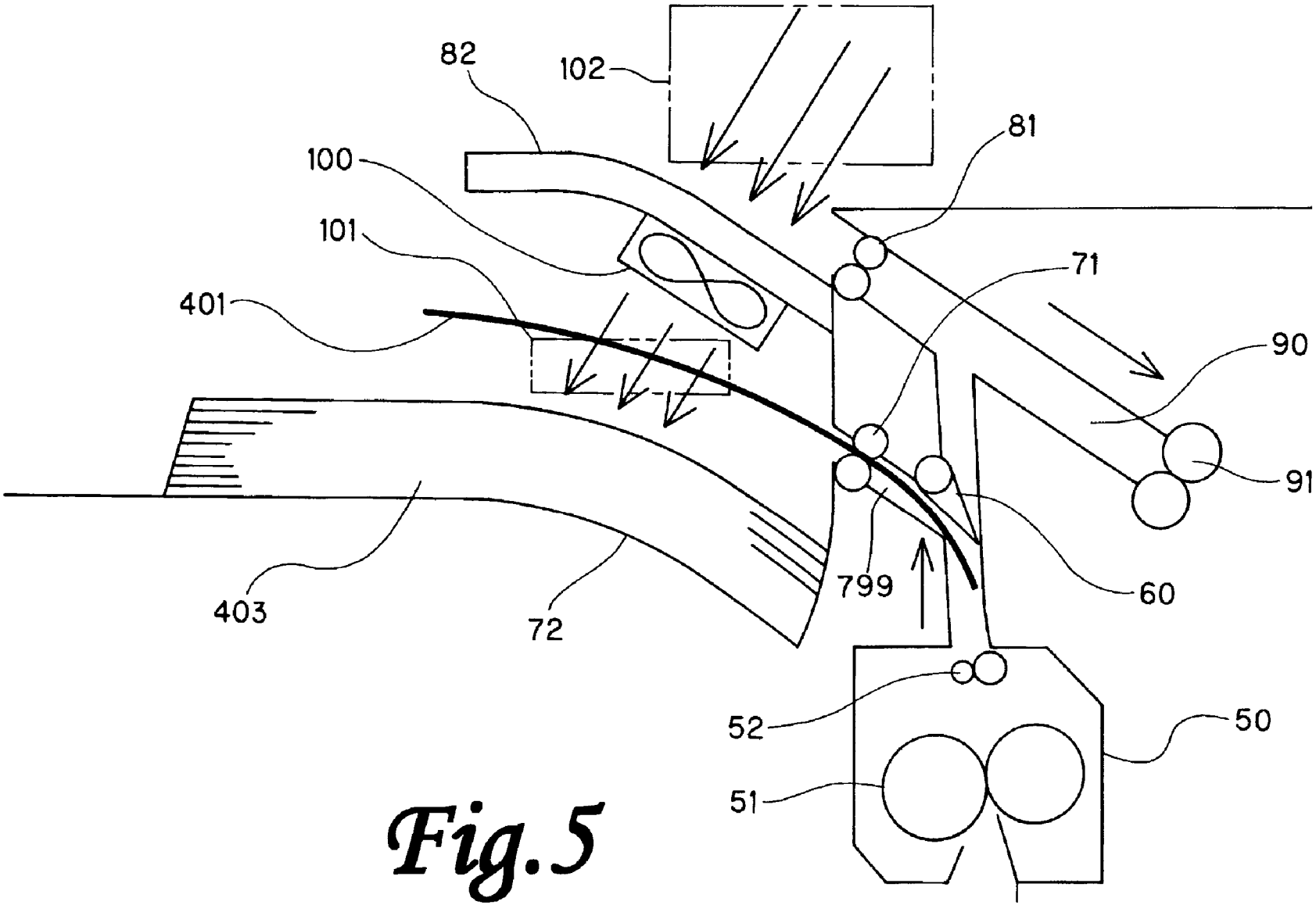
FIG. 5 is a schematic diagram for explaining cooling of sheet stacked in the image forming apparatus of the first embodiment of the present invention.
Figure 6:
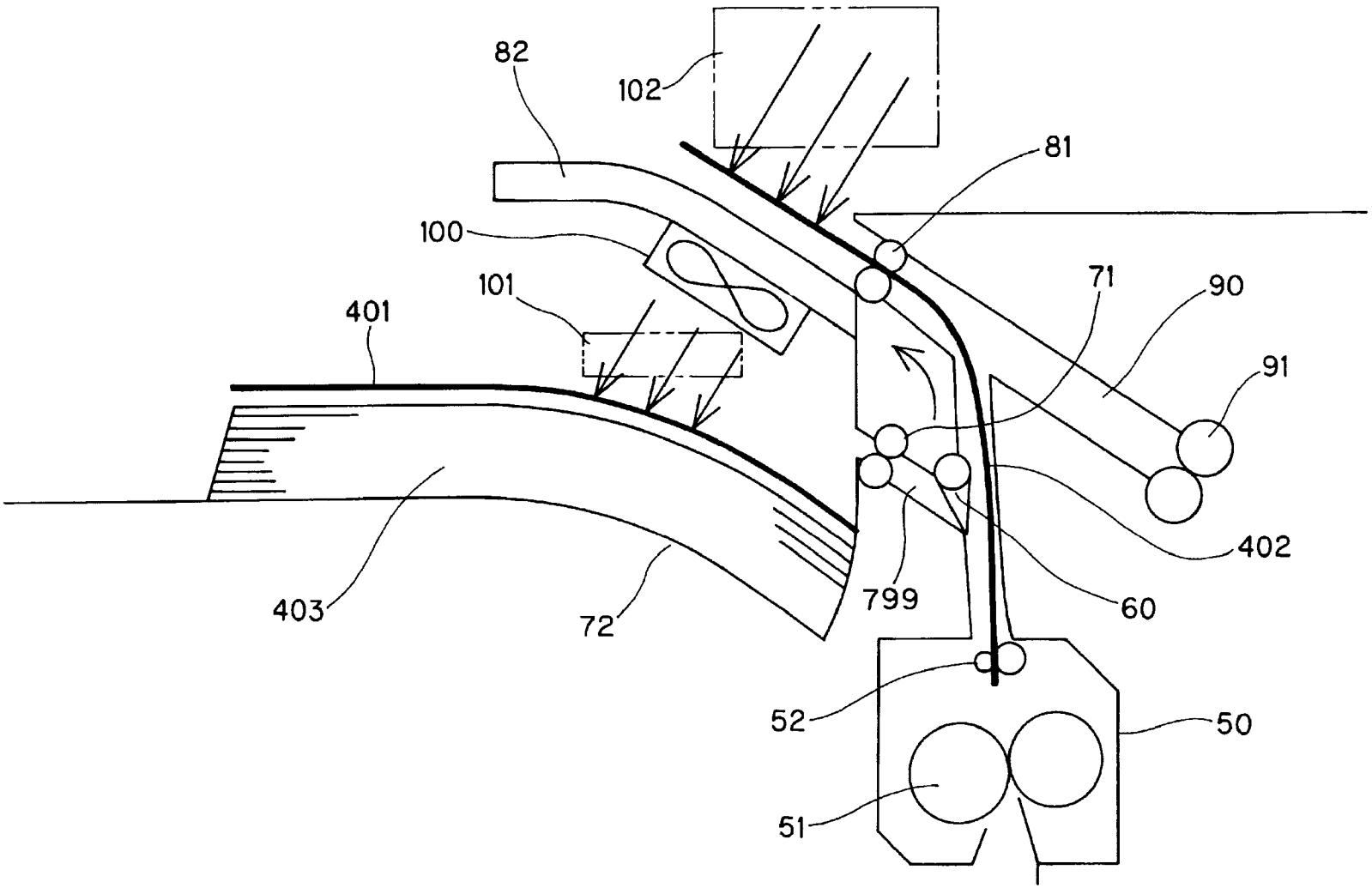
FIG. 6 is a schematic diagram for explaining cooling of a reversed sheet in the image forming apparatus of the first embodiment of the present invention.
Figure 7:
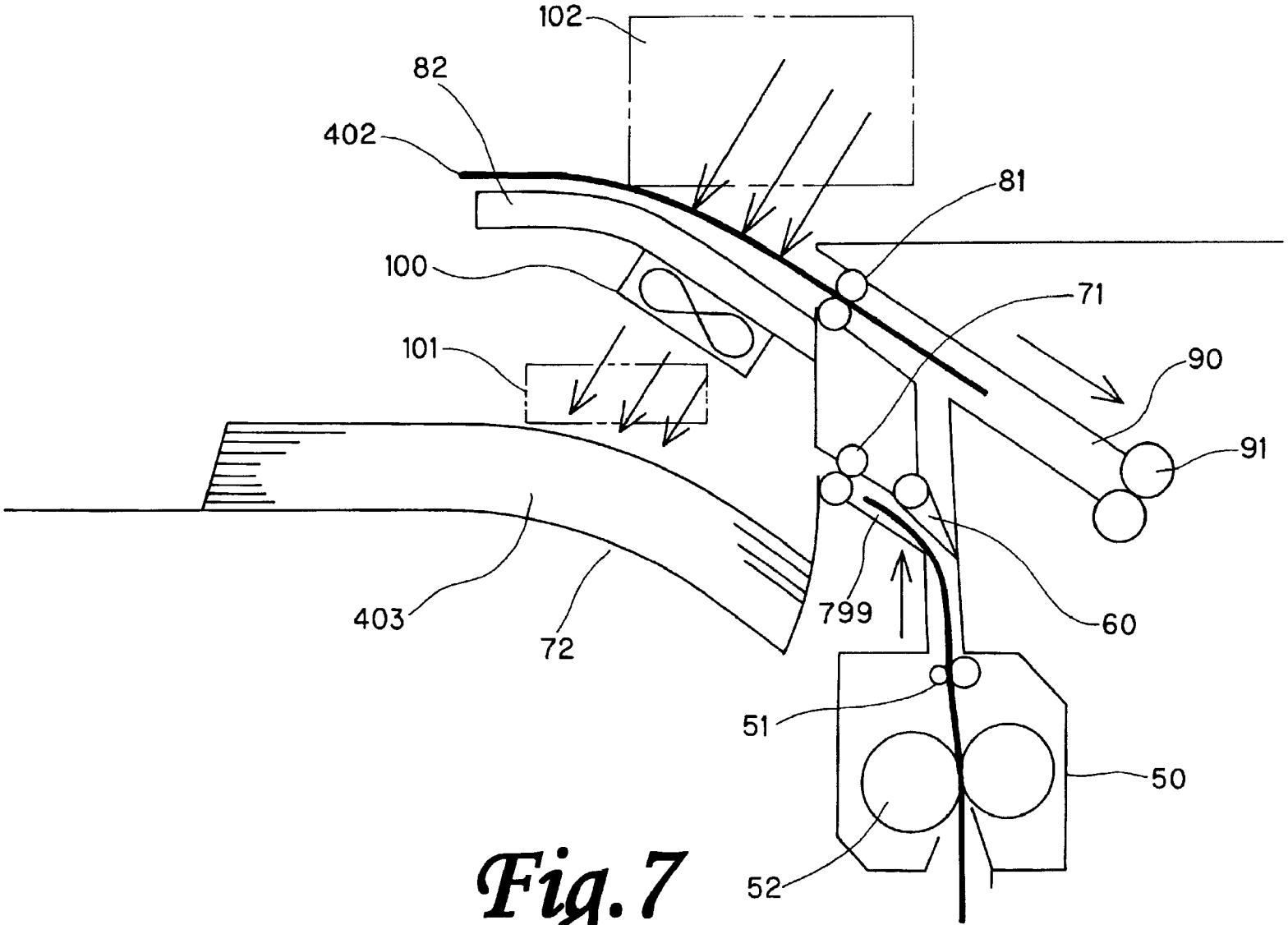
FIG. 7 is a schematic diagram for explaining cooling of the stacked sheet in the image forming apparatus of the first embodiment of the present invention.

Next, cooling process will be described. FIGS. 5, 6, and 7 show the operation of the image forming apparatus in the cooling process.

As shown in FIGS. 5 to 7, after an image is fixed, the transfer sheet 400 is carried to a next process by the flapper 60 capable of changing over between the discharge passage 799 and the reversal passage.

First, as shown in FIG, 5, the transfer sheet 400 after the two-side print is finished is conveyed to the discharge stacking unit 70 and cooled by discharge air 101 from the cooling fan 100 and after that, stacked on the stacking tray 72 as the transfer sheet (discharged sheet 401, to be discharged by the discharge roller pair 71. Consequently, heat due to fixing processing is lowered thereby preventing stacked transfer sheets (stacking sheet 403) from adhering to each other and occurrence of image fault.

Because the discharged and stacked sheet is always cooled by actuating the cooling fan 100, the temperature of the stacked sheets 403 is not raised easily. As a result, the transfer sheet 400 is cooled further during stacking thereby preventing adhesion of the sheets and occurrence of image fault. Further, because the curl can be reduced by cooling the transfer sheet 400, the stacking performance can be improved.

On the other hand, as shown in FIG. 6, intake air 102 generated by the cooling fan 102 is blown against a reversed transfer sheet (reversed sheet 402) so as to lower the temperature of the sheet and consequently, the curl is reduced like in case of the discharged sheet 401.

As shown in FIG. 7, the transfer sheet 402 in which an image is formed on its first face is conveyed to the repeated feeding unit successively via the conveying roller pairs 91, 92, 93, 94 in order to transfer a toner image to the second face.

Consequently, bad influences upon conveyance of the sheet after reversal and transfer of an image, more specifically, breaking of the front end, winding around the roller of the sheet, jam, transfer failure, skewing and the like can be prevented. Further, by lowering the temperature of the reversed sheet 402, the temperature inside the apparatus can be prevented from being raised by insertion of a sheet on which the image is formed into the image forming apparatus in a reversed state.

As described above, according to the first embodiment, by cooling the discharged sheet 401 directly with the discharge air 101 of the cooling fan 100 so an to lower the temperature of the discharged sheet 401, adhesion of the sheets and image fault can be prevented. Further, the amount of the curl can be reduced by cooling the sheet thereby improving stacking performance. By blowing intake air generated by such a cooling means as the cooling fan 100 against the transfer sheet 402, the temperature of the sheet is lowered and the amount of the curl is reduced. Consequently, bad influences upon conveyance of the sheet after reversal and transfer of an image, more specifically, breaking of the front end, winding around the roller of the sheet, jam, transfer failure, skewing and the like can be prevented. A rise in temperature inside the apparatus can also be blocked.

Second Embodiment

Next, the second embodiment of the present invention will be described. In the second embodiment, an operating sequence of a cooling unit is set up depending on the kind of the sheet and conveyance speed. This setting is preferable from viewpoints of energy saving and prevention of operating noise.

More specifically, in setting of the operating sequence, no cooling means (fan 100) is used for one-side printing or two-side printing if a thin paper in which fixing heat is cooled easily is employed. In case of an ordinary paper, adhesion of toners is prevented by actuating the cooling unit only at the time of the two-side print. For a thick paper or OHT in which the fixing heat is not cooled easily, the cooling means is actuated for both the single-side printing and the two-side printing. By setting such an operating sequence, energy saving can be achieved while maintaining image quality.

TABLE 1

COOLING FAN OPERATING SEQUENCE

| | SINGLE-SIDE PRINTING | TWO-SIDE PRINTING |
|---|---|---|
| THIN PAPER | OFF | OFF |
| ORDINARY PAPER | OFF | ON |
| THICK PAPER | ON | ON |
| OHT | ON | ON |

For the kind of the transfer sheet, the single-side printing and two-side printing, the operation of the image forming apparatus can be optimized by controlling the rotation speed of the cooling fan 100 by means of a control unit 789. In the meantime, the cooling fan is controlled under the above-set condition by the control unit 739 provided on the image forming apparatus.

Third Embodiment

Figure 8:
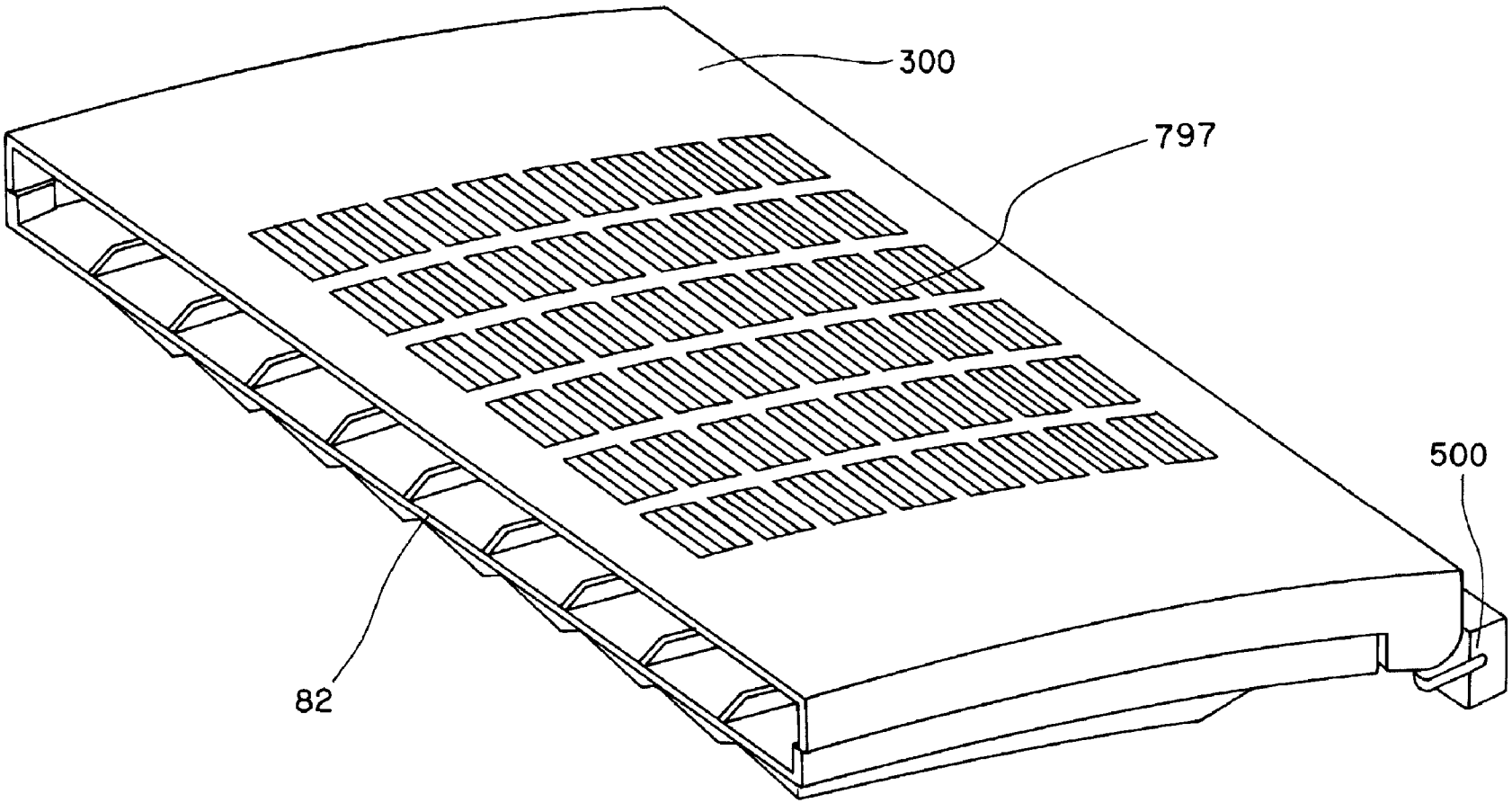
FIG. 8 is a perspective view showing a closed state of the reversal tray and reversing upper cover equipped with the cooling fan in the image forming apparatus of a third embodiment of the present invention.
Figure 9:
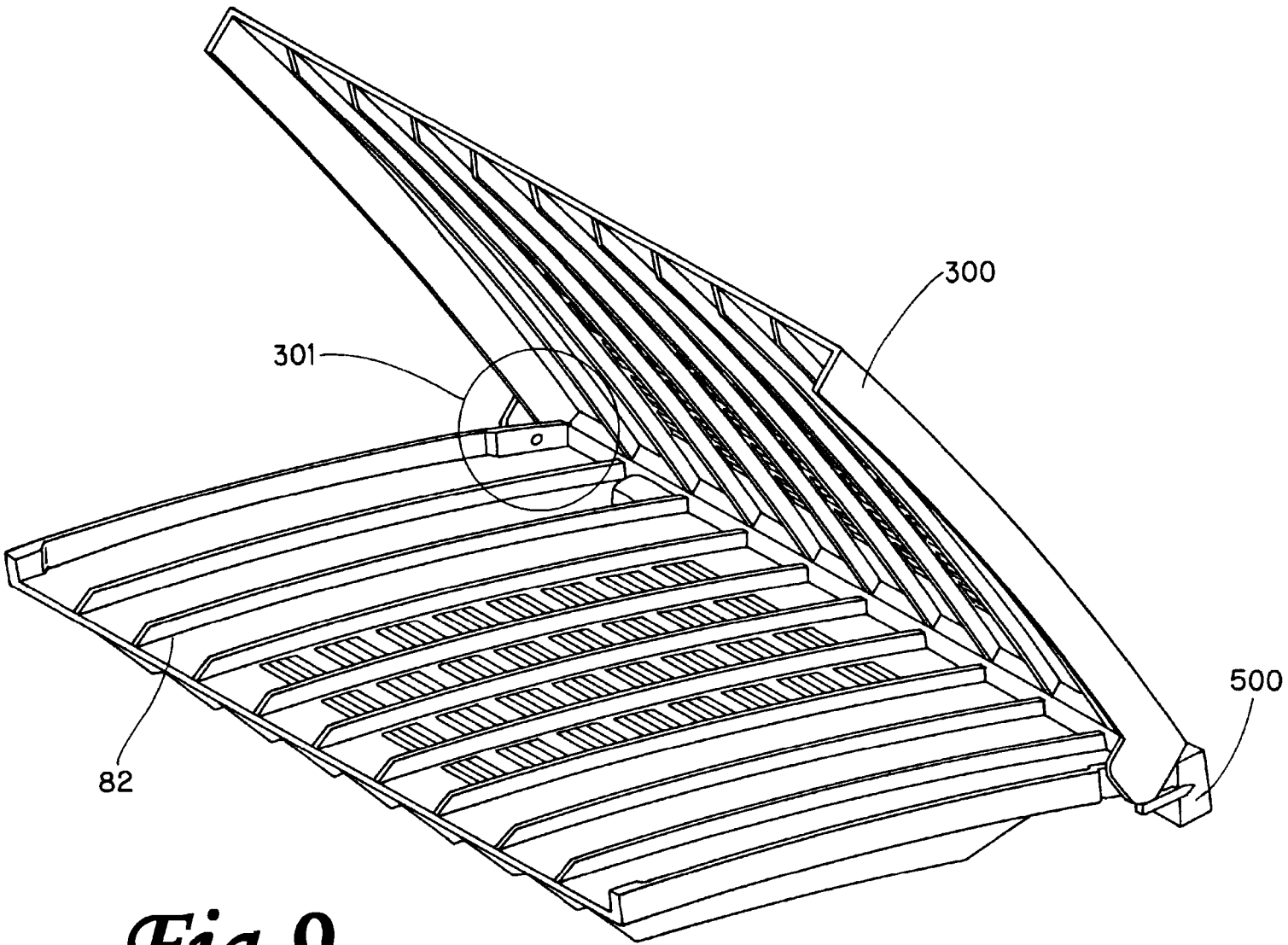
FIG. 9 is a perspective view showing an open state of the reversal tray and reversing upper cover equipped with the cooling fan in the image forming apparatus of the third embodiment of the present invention.

Next, the third embodiment of the present invention will be described. In the meantime, description of the same structure as in the first and second embodiments is omitted. FIGS. 8 and 9 show a reversal tray of the third embodiment.

As shown in FIG. 3, in the reversal tray of the third embodiment, a rotatable reversal top cover 300 is provided above the reversal tray 82. This protects a reversed sheet from being picked up mistakenly by user. To maintain jam treatment capacity, as shown in FIG. 9, the reversal top cover 300 is rotated about a hinge 301 so that the reversal tray 82 and the reversal top cover 300 can be opened/closed. The bottom face of the reversal top cover 300 guides the sheet being reversed. That is, the reversal top cover 300 forms reversal conveying path. An opening 797 which, air stream generated by the fan 100 passes through is formed on the reversal top cover 300. In the meantime, because other structure is the same as in the first, embodiment and the second embodiment, description thereof is omitted.

In this third embodiment, the same effect as in the first embodiment can be obtained and at the same time, the reversed sheet is protected from being picked up mistakenly by user.

Fourth Embodiment

Next, the fourth embodiment of the present invention will be described. The fourth embodiment is so constructed that the air discharge direction and the air intake direction can be changed by rotating the cooling fan in an opposite direction or reversing the installation condition of the cooling fan in a structure in which the temperature of the reversal sheet is higher than the temperature of the discharge sheet. In that case, a guide lid is provided above the reversal tray for the reversed sheet not to be floated. Because the other structure is the same as in the first embodiment, description thereof is omitted.

This fourth embodiment can provide the same effect as in the first embodiment.

Although the embodiments of the present invention have been, described specifically, the present invention is not limited to the above-described embodiments but may be modified in various ways based on the technical idea of the invention.

Although an image forming apparatus using four colors has been described as the image forming apparatus in the above-described embodiments, the same structure may be adopted for an image forming apparatus for a single color and image forming apparatuses for four or more colors.

According to the above-described embodiments, first, adhesion of the stacked sheet is prevented, second, image fault in the sheet stacked on the stacking tray 72 is prevented, third, failure of conveyance of sheet or transfer is prevented by reduction of curl in the reversal sheet, and fourth, rise of the temperature within the image forming apparatus is prevented.

Because according to the above-described embodiment, the fan 10 is provided between the stacking tray 72 and a reversal conveying path formed by the reversal tray 82 provided above the stacking tray 72, the sheet supported by the stacking tray 12 and the sheet supported by the reversal tray 82 are cooled effectively. Because the fan 100 is held by the reversal tray 82, the fan 100 is located on the top face of the sheet stacked on the stacking tray 72. Therefore, air from the fan 100 directly hits the top face of the sheet stacked on the stacking tray 72 and consequently, the sheet stacked on the stacking tray 72 can be cooled effectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-071331, filed Mar. 15, 2006, which, is hereby incorporated by reference herein in its entirety.

What is claimed is:

1. An image forming apparatus comprising:

an image forming unit having an image bearing member for bearing a toner image;

a transfer unit which transfers a toner image on the image bearing member to a sheet;

a fixing unit which fixes the toner image transferred by the transfer unit on the sheet by heat;

a discharging member which discharges the sheet on which the toner image is fixed by the fixing unit;

a stacking portion on which the sheets discharged by the discharge member are stacked;

a reversing roller pair which is rotatable normally/reversibly and which conveys the sheet on which the toner image is fixed by the fixing unit in a first direction and thereafter conveys the sheet in a second direction that is an opposite direction of the first direction;

a repeated feeding passage that conveys the sheet, which has been conveyed in the second direction by the reversing roller pair, to the image forming unit again;

a plate-like tray that is disposed above the stacking portion and on a side of the first direction with respect to the reversing roller pair, and guides the sheet being conveyed by the reversing roller pair;

an opening, through which an air passes, formed in the plate-like tray; and a fan which cools the sheet stacked on the stacking portion and the sheet being conveyed by the reversing roller pair while the sheet is being guided by the plate-like tray, wherein the fan is mounted on a bottom of the plate-like tray.

2. The image forming apparatus according to claim 1, wherein the fan faces an upper surface of the stacking portion.

3. The image forming apparatus according to claim 1, wherein the fan is held by the plate-like tray, and the fan sucks air from an area above the plate-like tray and blows the sucked air against the sheet stacked on the stacking portion.

4. The image forming apparatus according to claim 1, wherein ribs are formed on an upper surface of the plate-like tray.

5. The image forming apparatus according to claim 3, wherein the plate-like tray is attached detachably to the apparatus main body.

6. The image forming apparatus according to claim 1, wherein the stacking portion is provided on the upper surface of an apparatus main body, the plate-like tray is extending from the apparatus main body along the upper surface of the apparatus main body, and the fan is mounted on the bottom of the portion of the plate-like tray extending from the apparatus main body.

7. The image forming apparatus according to claim 1, wherein the discharging member is a discharge roller to discharge the sheet onto the stacking portion, and the discharge roller and the reversing roller pair are arranged side by side vertically.

* * * * *